2/8/83 XR 4,373,119

United States Patent [19]

Feder

[11] 4,373,119

[45] Feb. 8, 1983

[54] ADJUSTABLE TRANSDUCER

[75] Inventor: Alvin Feder, Lauderhill, Fla.

[73] Assignee: Motorola, Inc., Schaumburg, Ill.

[21] Appl. No.: 213,425

[22] Filed: Dec. 5, 1980

[51] Int. Cl.[3] ..... H04R 17/00

[52] U.S. Cl. ..... 179/110 A; 179/179; 310/322; 310/324

[58] Field of Search ..... 179/110 A, 179, 181 R; 181/148, 171, 158; 310/322, 353, 324

[56] References Cited

U.S. PATENT DOCUMENTS

| | | | |
|---|---|---|---|
| 2,123,236 | 7/1938 | Fair . | |
| 2,133,647 | 10/1938 | Pierce . | |
| 3,222,462 | 12/1965 | Karmann et al. | 179/110 A |
| 3,999,020 | 12/1976 | Bastiaans et al. | 179/180 |
| 4,167,223 | 9/1979 | Liesse | 181/131 |

FOREIGN PATENT DOCUMENTS

| | | | |
|---|---|---|---|
| 2057225 | 3/1981 | United Kingdom | 179/110 A |

*Primary Examiner*—G. Z. Rubinson

*Assistant Examiner*—S. D. Schreyer

*Attorney, Agent, or Firm*—John H. Moore; James W. Gillman; Edward M. Roney

[57] ABSTRACT

An adjustable transducer apparatus includes a transducer fixedly mounted on a metal plate, a saucer-shaped housing with a pair of concentric inner ridges, a planar annular cover plate, the rim of which rests of the outer ridge, a transducer element fixedly mounted on a metal plate, the rim of the metal plate resting on the inner edge, an "O" ring disposed in the housing between the cover plate and the metal plate for cushioning the metal plate against the housing, and a plurality of screws for adjustably fastening the cover plate against the housing so that the cover plate is pivoted about the outer ridge to produce a compression on the "O" ring, and that said "O" ring in turn holds the metal plate in place in the housing. The maximum alertness of the transducer is obtained by adjusting the screws and thereby adjusting the chamber formed by the housing and the planar annular cover plate.

6 Claims, 2 Drawing Figures

ADJUSTABLE TRANSDUCER

FIELD OF THE INVENTION

This invention relates to a transducer apparatus and, more particularly, an improved transducer apparatus with means for adjusting its alertness to a maximum.

BACKGROUND OF THE INVENTION

Piezoelectric transducers are used in a speaker for converting electrical wave into a sound wave. Typically, a clamping device is used to put pressure directly onto the piezoelectric ceramic or crystal used as the transducer element, as illustrated in the U.S. Pat. No. 2,123,236. Change in the clamping pressure causes a shift in the point of contact of the crystal with the supporting element of the crystal and the shift causes a change in the frequency of the vibration provided by the transducer.

The variation in the bending of the electrode made of the metal plate holding the transducer element such as piezoelectric ceramic or crystal also causes a change in the frequency. The prior art piezoelectric transducer apparatus and, in particular, the crystal holder of the transducer apparatus are found to be deficient in that the pressure applied directly to the transducer element such as the piezoelectric ceramic or crystal does not permit the adjustment of the overall transducer apparatus to the maximum alertness possible.

SUMMARY OF THE INVENTION

It is an object of the present invention to overcome the aforementioned shortcomings of the prior art transducer.

It is another object of the present invention to provide a more simple, rugged and reliable transducer apparatus which can be adjusted to be more alert or responsive.

In accordance with the present invention, the foregoing objectives are attained, and the shortcomings are problems of the prior art transducer apparatus are overcome by providing an adjustable transducer apparatus. An adjustable transducer apparatus includes a metal plate, a transducer fixedly mounted on a metal plate in the middle area thereof, a saucer-shaped housing with a pair of concentric inner ridges, a cover plate, the rim of which rests on the outer ridge, the transducer element fixedly mounted on a metal plate, the rim of the metal plate resting on the inner ridge, an "O" ring disposed in the housing between the cover plate and the metal plate for cushioning the metal plate against the housing, and a plurality of screws for adjustably fastening the cover plate against the housing so that the cover plate is pivoted about the outer ridge to produce a compression on the "O" ring, said "O" ring transmitting pressure to the metal plate of the transducer. The maximum alertness of the transducer is obtained by adjusting the screws.

The adjustable transducer apparatus of the present invention will be described with reference to an illustrative embodiment shown in the accompanying drawings.

DESCRIPTION OF THE PREFERRED EMBODIMENT

Figure 1:
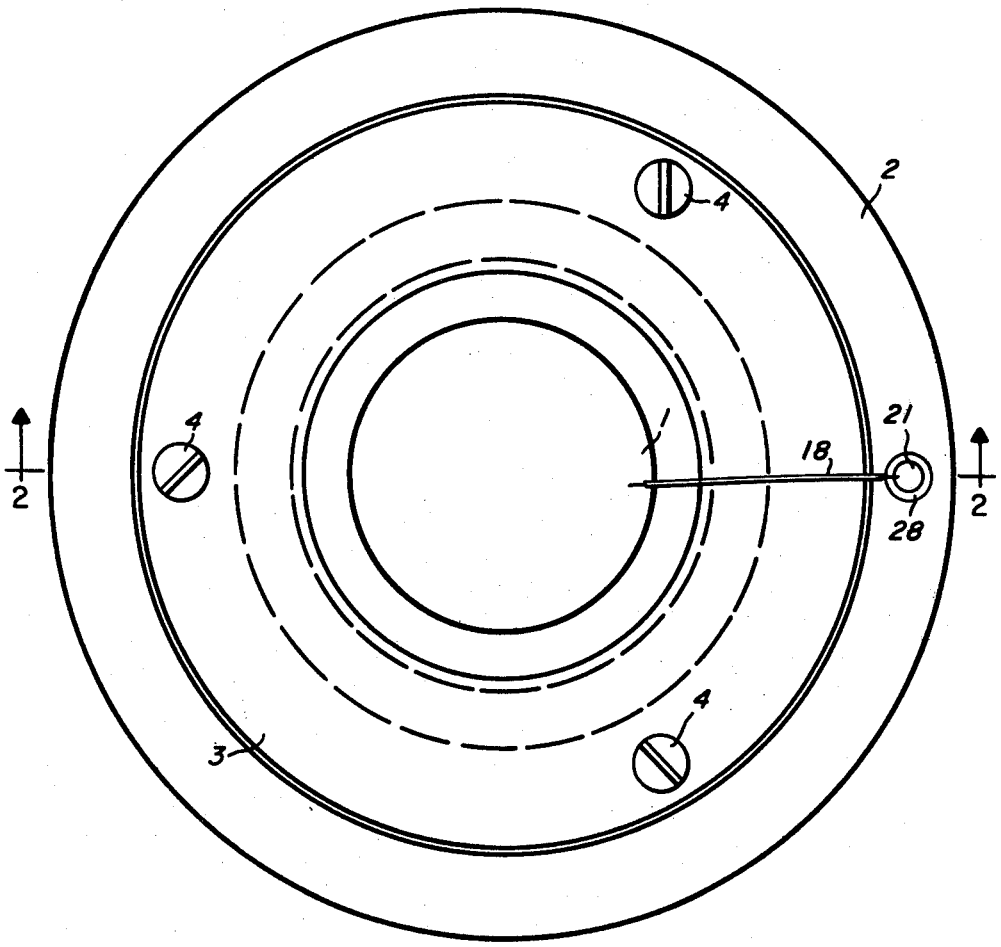
FIG. 1 shows a top view of the adjustable transducer apparatus in accordance with the present invention.
Figure 2:
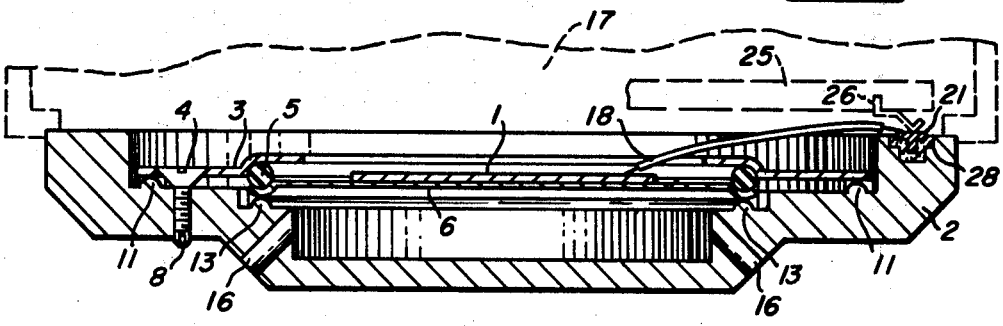
FIG. 2 shows a cut-away, side view of the adjustable transducer apparatus along 2—2 of FIG. 1.

As illustrated in FIGS. 1 and 2, there is shown an adjustable transducer apparatus which includes a piezoelectric or crystal element as the transducer element 1 housed within a saucer-shaped housing 2 and a planar annular cover plate 3. As shown in FIGS. 1 and 2, the housing 2 is of a saucer shape, the inside of which is recessed generally in a staircase fashion so that there are two distinct steps, the first step generally being defined by a recess with a protruding ridge 11 and a second step that gives a narrower diameter with a protruding ridge 13. The two ridges 11 and 13 are concentric, as illustrated in FIG. 2, and are dimensioned to provide pivoting surfaces.

The outer rim of the flat planar annular cover plate 3 rests on the outer ridge 11 and is fastened onto the saucer-shaped housing 2 by means of three flat-head screws 4. An "O" ring 5 is interposed between a metal plate 6 and the cover plate 3. The rim of the metal plate rests on the inner ridge 13 and the transducer 1 is fixedly mounted on the middle of the plate. The flathead screws are located between the "O" ring and the outer ridge 11.

The "O" ring cushions the mtal plate 6 against the pressure applied thereto when the flat-head screws 4 are screwed to tighten the cover plate 3 against the housing.

By adjusting the degree with which the screws are tightened, the pressure exerted by the cover plate against the "O" ring is adjusted. The "O" ring, in turn, transmits the pressure to the metal plate 6 to which the transducer element is fixedly mounted. The three screws can be adjusted at the head end or at the tip end 8 with a suitable slot.

Electrical connection is made from the transducer element to an external circuit through a flexible conductor wire 18 by soldering one end of it to the element and the other end to an insulated contact terminal 21 disposed on the housing as shown. The external circuit may be any circuit, such as radio signal receiver 25. The circuit may be connected to the element via a spring or a rivet contact 26 that establishes a pressure contact to the contact terminal 21. The contact terminal 21 is insulated from the metal housing by insulation 28. If a plastic housing is used, no insulation is required. Electrical energy is supplied by a battery through the radio receiving circuitry.

The periphery of the metal plate 6 is shaped concave to receive the "O" ring therein. The planar annular cover plate 3 is bent or indented to form a suitable surface to hold the "O" ring. Thus, for example, a quarter toroid surface is formed intermediate the plate to provide a quadrannular concave surface opposite the concaved periphery of the metal plate to retain the "O" ring in position. The concaved retaining surfaces of the metal plate 6 and the planar plate 3 make it possible to retain the "O" ring firmly in place. This, in turn, makes it possible to retain the metal plate 6 holding the transducer element 1 also firmly in place. The housings are tapped therethrough to permit the screw tips 8 to go therethrough. By adjusting the degree with which the screws are tightened at their heads, the pressure applied to the transducer via the planar cover plate 3, "O" ring and the metal plate 6 is shown adjusted. The tip ends of the screws are slotted as shown. This makes it possible to adjust the pressure applied to the transducer element 1 via the tip ends of the screws exposed external to the saucer-shaped housing for ready access from the exterior thereof.

The enclosure formed by the plate 6 and the bottom of the housing forms a chamber for generating acoustic wave when the piezoelectric transducer element 1 is subjected to varying electrical signals from the circuit 25. Sound wave is allowed to emanate from the chamber to the outside through openings 16 positioned diagonally downwardly through the side of the housing.

Advantageously, the transducer apparatus of the present invention makes it possible to adjust the alertness of the transducer by adjusting the pressure applied to the metal plate holding the transducer element indirectly through the "O" ring which transmits pressure applied to a cover plate. Adjustment of screws adjusts the size of the chamber space formed by the housing and the planar annular cover plate and thereby renders the transducer apparatus more alert.

Various changes and modifications may be made to the present inventive adjustable transducer apparatus without departing from the spirit and scope thereof.

What is claimed is:

1. An adjustable transducer apparatus comprising:

a saucer-shaped housing with two inner concentric ridges;

a planar cover plate, the outer rim of which rests on the outer ridge of the two concentric ridges;

a metal plate;

a transducer element fixedly mounted on the center of the metal plate, the rim of said metal plate resting on the inner ridge of the two concentric ridges;

an "O" ring disposed in the housing between the planar cover plate and the metal plate and opposite the inner ridge for holding the metal plate against the housing; and a plurality of screws for adjustably fastening the planar cover plate against the housing at intermediate points between the outer and inner ridges so that the planar cover plate is pivoted about the outer ridge to produce compression on the "O" ring and said "O" ring transmitting pressure to the metal plate of the transducer, wherein the alertness of the transducer is obtained by adjusting the screws.

2. An adjustable transducer according to claim 1, wherein the periphery of the metal plate is concave to retain the "O" ring.

3. An adjustable transducer according to claim 2, wherein the planar cover plate has a quarter toroidal surface to retain the "O" ring in position.

4. An adjustable transducer according to claim 3, the concave surface and the quarter toroidal surface mate with the "O" ring such that the metal plate is held securely in the same place in the housing.

5. An adjustable transducer according to any one of the claims 1 to 4, wherein the saucer-shaped housing is provided with a plurality of apertures through the housing wall thereof to the exterior from the chamber defined by the housing and the metal plate.

6. An adjustable transducer according to claim 4, wherein said transducer is coupleable to a receiver, said receiver to be positioned to enclose the entire face of the transducer, wherein the housing walls are tapped so that the tips of the screws are allowed to go therethrough and the tip ends of said screws are slotted so that final alertness adjustment can be made from the tips of the screws.

* * * * *